United States Patent [19]

Krause

[11] Patent Number: 4,711,489

[45] Date of Patent: Dec. 8, 1987

[54] CHILD SEAT ASSEMBLY FOR WHEELCHAIR

[76] Inventor: Hugh A. Krause, R.R. 6 Box 190 188, Bemidji, Minn. 56601

[21] Appl. No.: 827,385

[22] Filed: Feb. 7, 1986

[51] Int. Cl.[4] ..... A47C 15/00

[52] U.S. Cl. ..... 297/243; 297/250; 297/DIG. 4; 280/289 WC

[58] Field of Search ..... 297/250, 251, 243, 245, 297/440, DIG. 4; 280/289 WC, 289 A, 202

[56] References Cited

U.S. PATENT DOCUMENTS

| | | | |
|---|---|---|---|
| 2,530,544 | 11/1950 | Schwantes | 297/DIG. 4 |
| 2,769,482 | 11/1956 | Carlson | 297/243 X |
| 2,993,702 | 7/1961 | Gill | 297/243 X |
| 3,318,615 | 5/1967 | Chreist, Jr. | 297/250 X |
| 3,873,127 | 3/1975 | McNichol, Jr. et al. | 297/243 X |
| 3,998,490 | 12/1976 | Lallave | 297/243 |
| 4,288,124 | 9/1981 | Hamilton | 297/DIG. 4 |
| 4,389,057 | 6/1983 | Richard, Jr. | 280/289 WC |
| 4,436,339 | 3/1984 | Albers | 297/DIG. 4 |
| 4,566,732 | 1/1986 | Ostergaard, II et al. | 297/DIG. 4 |

FOREIGN PATENT DOCUMENTS

| | | | |
|---|---|---|---|
| 971253 | 9/1964 | United Kingdom | 297/243 |

*Primary Examiner*—Peter A. Aschenbrenner
*Assistant Examiner*—Mark W. Binder

[57] ABSTRACT

A collapsable, detachable child seat for mounting on a wheelchair having as its basic elements two identical frames supporting a fabric seat which slides into receiving members attached to tubular frame of said wheelchair.

5 Claims, 4 Drawing Figures

CHILD SEAT ASSEMBLY FOR WHEELCHAIR

BACKGROUND OF THE INVENTION

The invention relates to a child's seat which may be mounted on and removed from a wheelchair by its occupant or other person not occupying the wheelchair.

Individuals using wheelchairs have always had the problem of carrying objects while wheeling with their hands. For a wheelchair user, carrying a child in his or her lap can be difficult, disheartening and dangerous. The fact that a child is not an inanimate object but a moving human being adds to the frustration.

Prior art does not reveal any child's seats specifically designed to be mounted on a wheelchair, although accessories for wheelchairs such as tables, shopping baskets, trays, and other attachments are evident.

SUMMARY OF THE INVENTION

An object of this invention is to provide a child seat assembly for a wheelchair user.

Another object of this invention is to provide a child seat assembly which can be mounted on and removed from most wheelchairs by its occupant or other person.

A further object of this invention is to provide a child seat assembly which is stongly constructed yet lightweight to prevent the addition of hindering weight to the wheelchair.

Another object of this invention is to provide a child seat assembly which is collapsable for convenient carrying and storage.

Another object of this invention is to provide a child seat which is mounted in front of wheelchair user, facing toward or away from said user, which increases a carried child's safety without limiting wheelchair user's visibility.

Other objects and characteristics will become plain in the detailed description which follows. It should be noted, however, that this invention comprises a tubular frame with square stock vertical support shafts. Both frame and shafts are made of a strong, lightweight material. Attached to and suspended between the frames, is a heavy, breathable fabric seat which is detachable to allow laundering and has a restraint belt attached to the seat material. The vertical support shafts slide into square stock receiving members of a larger dimension also made of a strong, lightweight material. Receiving members are attached to tubular frame of the wheelchair with adaptors and clamps which allow removal, but may also remain permanently in place without hindering wheelchair use without child seat assembly attached.

DETAILED DESCRIPTION OF THE INVENTION

Figure 1:
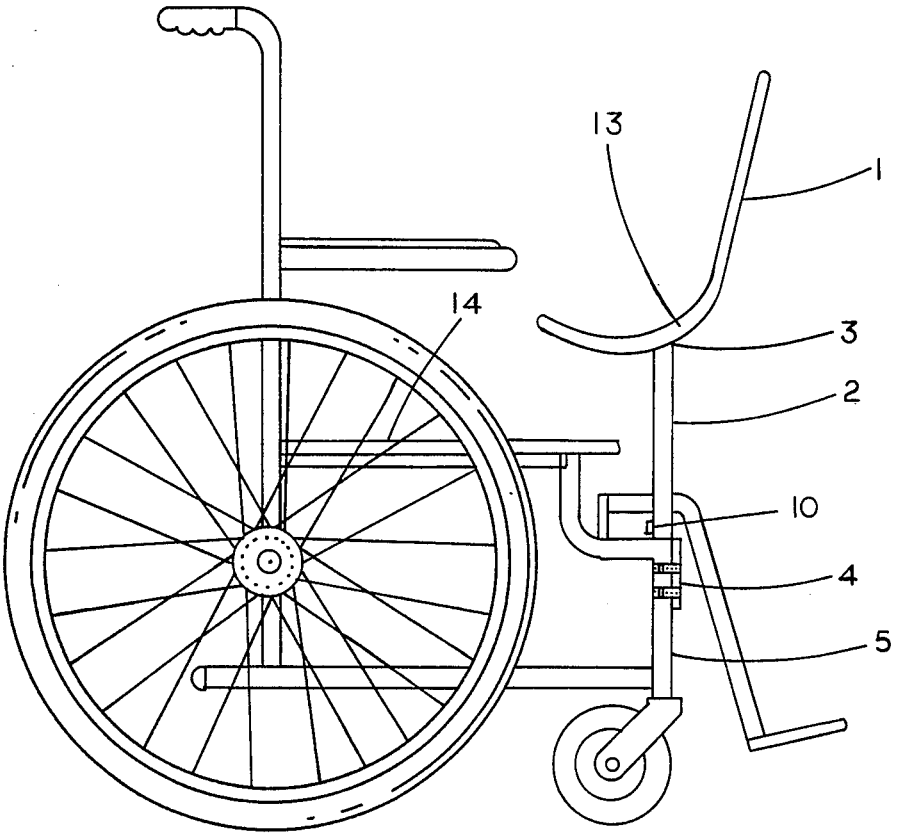
FIG. 1 is a side elevation of the child seat assembly as it appears when mounted on a wheelchair.
Figure 3:
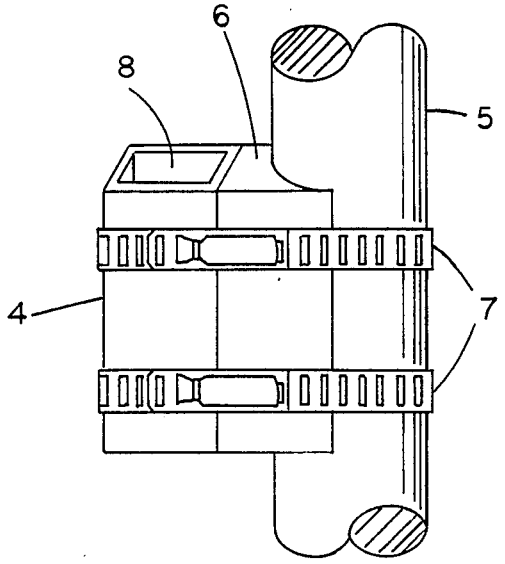
FIG. 3 is an enlarged three dimensional detail of child seat assembly's receiving member attachment to wheelchair.
Figure 2:
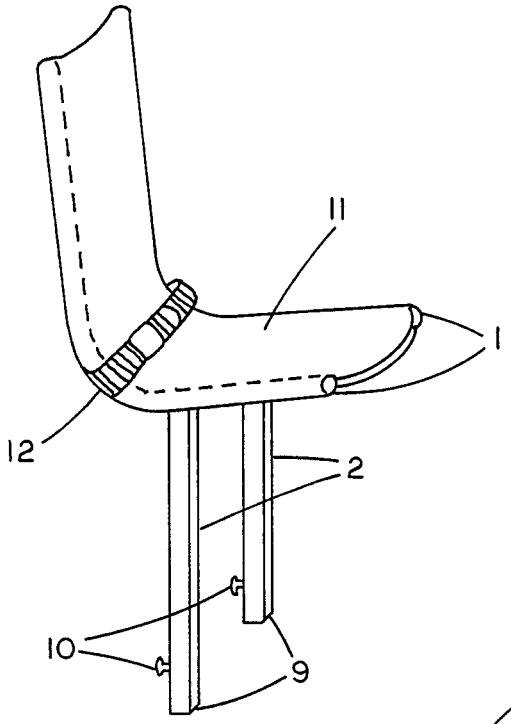
FIG. 2 is a three dimensional detail of child seat assembly from upper left.
Figure 4:
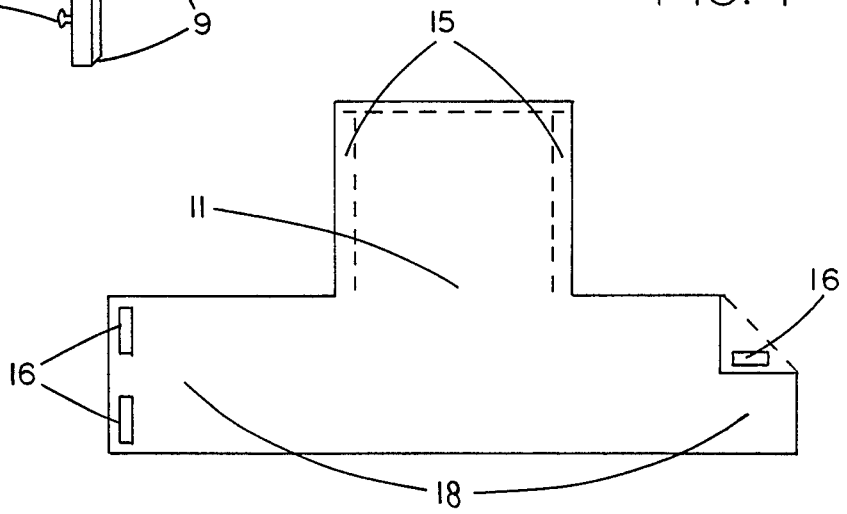
FIG. 4 is a layout of fabric seat panel for child seat assembly.

Referring to the drawings, the child seat assembly 13, consists of two tubular L-shaped frames 1 with one square stock vertical support shaft 2 permanently welded 3 perpendicularly downward to each horizontal leg of frames 1. A fabric panel 11 is sewn around and suspended between frames 1 with a restraint belt 12 which is attached to fabric panel 11 in rear and secures around front of child seat assembly occupant. Two square stock receiving members 4 and two flat-to-round mounting adaptors 6 are secured one each to forward vertical struts of wheelchair frame 5 with hose clamps 7 which tighten around receiving members 4, adaptors 6, and wheelchair frame 5.

To implement use of child seat assembly 13, the receiving members 4 and adaptors 6 are clamped 7 to the wheelchair frame 5. The receiving members 4 and adaptors 6 may be clamped 7 to inside, outside or forward area of wheelchair frame 5 depending upon design of individual wheelchair 14. The bottom ends 9 of support shafts 2 are then inserted into receiving member openings 8. A bolt 10 is attached to support shafts 2 to act as a positive stop. Child seat assembly 13 may be faced toward or away from wheelchair 14 occupant depending upon needs or preferences of occupant.

To detach child seat assembly 13, bottom ends 9 of support shafts 2 are lifted upward and out of receiving members 4. The adaptors 6, receiving members 4, and clamps 7 may be left permanently in place when not using child seat assembly 13 without impeding operation of wheelchair 14.

The fabric panel 11 sleeves 15 are placed onto vertical legs of the frames 1 and slid down to support shafts 2. Fabric panel 11 end flaps 18 are then wrapped downward around horizontal legs of the frames 1 and secured underneath child seat assembly 13 with fastening device 16, such as a hook and loop fastener means or snaps. When fasteners 16 are unfastened, fabric panel 11 may be removed for laundering. A restraint belt 12 is sewn to rear of child seat assembly 13 fabric panel 11 with ends wrapping around to secure in front of occupant of child seat assembly 13.

The frames 1, support shafts 2, and receiving members 4 are made of strong lightweight nonferrous metal, such as aluminum, graphite or magnesium to limit added weight to wheelchair 14. The adaptors 6 are made of a substance other than metal which would mar wheelchair frame 5, such as wood, plastic or nylon. The fabric panel seat 11 is made of a heavy yet breathable material which is washable.

The child seat assembly 13 is designed to be mounted on an occupied wheelchair 14, as needed, and detached when not needed. After detaching, child seat assembly 13 may be collapsed for convenient carrying and storage. The easy handling, convenient, and safe child seat assembly 13 was developed to improve the independence of disabled persons. The receiving member 4 of the child seat assembly 13 is designed simply to allow mounting on most wheelchairs with only minor modifications. Other modifications are being considered concerning the support shaft 2 shape, clamping device 7, and restraint belt 12 which do not depart from the scope of this invention and will increase its applications.

What is claimed is:

1. A child seat assembly for mounting on and removal from a wheelchair frame having vertical front struts, located in front of a wheelchair occupant facing toward or away from said occupant, having first and second framework in an L-shaped configuration permanently mounted on first and second support means which are attached perpendicularly downward from horizontal legs of said framework, and having a cloth panel with fastening means secured around and suspended between said framework, with child seat assembly occupant restraint means affixed to said panel rearwardly and secured forwardly, said support means insert into and extract from first and second receiving means with stopping means affixed to said support means to halt said support means at an optimum height above said wheelchair occupant, and which said receiving means attach to said wheelchair front vertical struts using first and second adaptor means in such a manner that said receiving means and said adaptor means lie parallel with said wheelchair struts and are held in place with securement means, said framework, support means, and receiving means being made of a strong, lightweight non-ferrous metal characterized by aluminum, magnesium or graphite to minimize adding undesired weight to said wheelchair, said cloth panel being of a heavy, breathable fabric to ensure durability, and said adaptor means being of a non-metal substance characterized by wood, plastic or nylon to prevent marring of said wheelchair frame, said securement means comprising at least first and second clamps for each said receiving means to dependably attach said receiving means and said adaptor means to said wheelchair frame.

2. A child seat assembly as described in claim 1, wherein said assembly collapses with said framework and said support means touching in a flat manner for convenient carrying and storage when not being mounted on said wheelchair.

3. A child seat assembly as described in claim 1, wherein said cloth panel may be completely removed from said frame when not in use for laundering.

4. A child seat assembly as described in claim 1, wherein said receiving means and said adaptor means remain permanently attached to said wheelchair frame using said securement means without impeding normal functioning of said wheelchair.

5. A child seat assembly as described in claim 1, wherein said receiving means and said adaptor means attach to front 180 degrees of most said wheelchairs' front struts to increase adaptability of said child seat assembly.

* * * * *